US010378158B2

(12) United States Patent
Neumann

(10) Patent No.: US 10,378,158 B2
(45) Date of Patent: Aug. 13, 2019

(54) ROAD PAVER OR FEEDER WITH MATERIAL RETENTION DEVICE WITH OVERLOAD PROTECTION, MATERIAL RETENTION DEVICE, AND METHOD FOR PROTECTING A MATERIAL RETENTION DEVICE

(71) Applicant: BOMAG GMBH, Boppard (DE)

(72) Inventor: Tobias Neumann, Remagen (DE)

(73) Assignee: BOMAG GMBH, Boppard (DE)

( * ) Notice: Subject to any disclaimer, the term of this patent is extended or adjusted under 35 U.S.C. 154(b) by 0 days.

(21) Appl. No.: 15/598,353

(22) Filed: May 18, 2017

(65) Prior Publication Data

US 2018/0002875 A1 Jan. 4, 2018

(30) Foreign Application Priority Data

May 18, 2016 (DE) ..... 10 2016 006 187

(51) Int. Cl.
*E01C 19/48* (2006.01)
*E01C 19/08* (2006.01)
(Continued)

(52) U.S. Cl.
CPC ..... *E01C 19/48* (2013.01); *E01C 19/08* (2013.01); *E01C 19/16* (2013.01);
(Continued)

(58) Field of Classification Search
CPC ..... E01C 19/29; E01C 19/405; E01C 19/48; E01C 19/40; E01C 23/14;
(Continued)

(56) References Cited

U.S. PATENT DOCUMENTS 3,000,277 A * 9/1961 Crane ..... E01C 19/008 404/118
3,726,544 A * 4/1973 Miller ..... B62D 25/188 280/851
(Continued)

FOREIGN PATENT DOCUMENTS

DE 10 2013 000 788 7/2014
DE 10 2014 012 461 1/2016
(Continued)

*Primary Examiner* — Abigail A Risic
(74) *Attorney, Agent, or Firm* — Grossman, Tucker, Perreault & Pfleger, PLLC

(57) ABSTRACT

A road paver or a feeder with a machine frame, a travel carriage powered by a drive unit, and a material hopper with a material retention device arranged in the front in the operating direction, the material retention device comprising a fastening device and a retention element fastened to the material hopper through the fastening device, the material retention device having an overload protection device, which is designed in such a way that in the event of an overload applied thereto the retention element is detached the from material hopper and the fastening device, the latter remaining on the hopper, without damage. A material retention device of such a road paver or feeder and a method for protecting a material retention device of such a road paver or feeder.

33 Claims, 5 Drawing Sheets

(51) Int. Cl.
*E01C 19/16* (2006.01)
*E01C 19/20* (2006.01)

(52) U.S. Cl.
CPC ..... *E01C 19/2045* (2013.01); *E01C 2301/02* (2013.01); *E01C 2301/08* (2013.01)

(58) Field of Classification Search
CPC .... E01C 2019/207; E01C 19/08; E01C 19/16; E01C 19/2045; E01C 2301/02; E01C 2301/08
See application file for complete search history.

(56) References Cited

U.S. PATENT DOCUMENTS 5,356,238 A * 10/1994 Musil ..... E01C 19/008 404/101
9,580,875 B1 * 2/2017 D'Ascanio ..... E01C 19/48
2009/0263193 A1 * 10/2009 Mayer ..... E01C 19/48 404/110
2013/0183092 A1 * 7/2013 Van Beek ..... E01C 19/48 404/72
2014/0037375 A1 * 2/2014 Frelich ..... E01C 19/48 404/72
2015/0132058 A1 * 5/2015 Anderson ..... E01C 19/48 404/84.05
2016/0040368 A1 * 2/2016 Frelich ..... E01C 19/48 404/110
2016/0060823 A1 * 3/2016 Erdtmann ..... E01C 19/48 404/110
2016/0326702 A1 * 11/2016 Fickeisen ..... E01C 19/48

FOREIGN PATENT DOCUMENTS

DE 10 2015 007 287 12/2016
WO 2016/061085 4/2016

* cited by examiner

ROAD PAVER OR FEEDER WITH MATERIAL RETENTION DEVICE WITH OVERLOAD PROTECTION, MATERIAL RETENTION DEVICE, AND METHOD FOR PROTECTING A MATERIAL RETENTION DEVICE

FIELD OF THE INVENTION

The invention relates to a road paver or a feeder. The invention also relates to a material retention device for a road paver or feeder and a method for protecting a material retention device of this type of road paver or feeder.

BACKGROUND

Generic road pavers or feeders, hereinafter also collectively referred to as road construction machines, are used for laying base layers, for example, concrete or asphalt layers, in the construction of roads and/or squares or for intermediate storing and transferring paving material during the paving process. The respective base layer is paved by a road paver, which is supplied with construction material for the base layer directly by a transport vehicle, for example, a truck, or via a feeder. When using a feeder, it is supplied with paving material by a transport vehicle, and transfers it via a suitable conveyor device to the road paver, which prepares the base layer. Both the paver and the feeder have a machine frame and a travel unit, for example, crawler tracks or wheels, driven by a drive unit, in most cases a diesel engine. In the operating direction of the road construction machine, it has a material hopper in the front. The operating direction refers to that direction in which the road construction machine moves during normal operation, i.e., during paving operation. The material hopper is a loading area for paving material, the size of which can be increased and/or decreased by moving and/or tilting the walls. The paving material is conveyed backwards or towards the rear from the material hopper via a conveyor device, for example, a scraper belt, through the road construction machine, where, in the case of a feeder, a conveyor device is arranged, which transfers the paving material from the feeder to the road paver. In the case of a road paver, a transverse conveyor, for example, a screw conveyor, and a paving screed are located on the rear, through which the paving material is spread across the entire paving width, smoothed, and pre-compacted. A smooth, pre-compacted base layer is left behind the road paver, which can be further compacted, for example, by rollers, in order to achieve a finished road and/or square.

The transfer of the paving material from the transport vehicle to the generic road construction machine, be it a feeder or a road paver, occurs respectively in the same way. A truck loaded with the paving material drives backwards to just in front of the road machine driving in the operating direction and then stops. A controlled collision between vehicles is then effected. For this, buffer rollers may be present, for example on the end of the road construction machine located in the front in the operating direction, which come into contact with the rear of the transport vehicle by slowly moving the road construction machine forward. The road construction machine then pushes the transport vehicle in front of it using the buffer rollers, while the paving process of the road paver is continued. The transport can then transfer the paving material, for example, by tilting the loading area backwards into the material hopper of the road construction machine arranged in the front in the operating direction. As soon as the transfer is completed, the loading area can be lowered again and the transport vehicle drives away in the forward direction.

To enable this type of material transfer from the transport vehicle to the road construction machine, the material hopper of the road construction machine cannot have any high, vertically projecting side walls in the front in the operating direction, but rather terminates relatively flatly in this area. Generic road construction machines therefore typically have a material retention device arranged on the material hopper in the front in the operating direction, which in turn comprises a fastening device and a retention element mounted on the material hopper via the fastening device. The material retention device and particularly the retention element, which is designed, for example, as a particularly flexible, elastic belt, ensure that as little as possible or ideally no paving material can fall out towards the front from the loading area of the material hopper in the operating direction of the road construction machine. The retention element therefore prevents a loss of paving material in the operating direction towards the front caused by trickling down out of the material hopper of the road construction machine. Because the material retention device is at the same time required to not obstruct the transfer of the paving material from the transport vehicle to the material hopper, the retention element is typically designed elastically, such that it may be deformed by a colliding part of the transport vehicle and can be pushed or bent to the side so that the transport vehicle can transfer the paving material without interference by the material retention device. This can be the case, for example, if the unloading transport vehicle departs from the road construction machine too soon and particularly with its loading area erected too far and still protrudes into the hopper with the lower edge of the loading area overlapping the retention device in the operating direction.

It is therefore still a problem that a large number of these loading processes are required during normal operation of the road construction machine and that sometimes, due to the transport vehicle and/or its loading area contacting the material retention device, particularly the retention element, such large tensile and/or compressive forces are exerted on the material retention device that the retention element is stripped out of the fastening devices on the material hopper and thereby destroyed. The stripped out material retention device can no longer fulfill its purpose and must be replaced. To this end, it is necessary to halt the paving with the road construction machine, remove the material retention device, and replace it with a new, intact material retention device, particularly a new retention element. The stripped-out retention elements are destroyed and must be disposed of. As a result, this increases maintenance times for replacing the retention elements. Moreover, new retention elements must be kept on hand for replacement, which complicates logistics and increases the operating costs of the road construction machine.

A generic road paver is described, for example, in DE 10 2013 000 788 A1 and a generic feeder is described in DE 10 2014 012 461 A1.

In light of the prior art, the object of the present invention is to simplify maintenance and operation of a generic road construction machine, i.e., a road paver or feeder, and to thereby save time and costs.

This object is achieved with the road paver or feeder, the material retention device, and the method according to the independent claims. Preferred embodiments are specified in the dependent claims.

SUMMARY

Specifically, the object is achieved for a road paver or feeder mentioned above by the fact that the material retention device has an overload protection device, which is designed in such a way that in the event of an applied overload the retention element comes off of the material hopper and the fastening device, which remains on the hopper, without damage. an overload develops, for example, through compressive and/or tensile forces applied on the retention element, which can arise particularly through contact or collision between the retention element and the rear of the transport vehicle. These forces can be substantially than those exerted on the retention element through retained paving material, so that an overload does not occur simply through the paving material in the material hopper. An overload refers, for example, to forces that would cause a retention element to become damaged and/or stripped out in conventional material retention devices. Thus, an overload refers to a force-related load above a threshold value, in excess of which the material device according to the invention is detached from its anchoring in a non-destructive manner without actuating the anchoring itself for this. Accordingly, overload protection is present if according to the invention the retention element detaches from the material hopper and the fastening device remaining thereon before forces of such a magnitude are applied to the material retention device that the material of the material retention device is destroyed. Ultimately, the overload according to the invention refers to a threshold value for forces applied to the material retention device, for which the overload protection of the invention comes into effect when it is reached and/or exceeded. The overload protection ensures that retention element detaches from the material hopper, while the fastening device, with which the retention element was mounted on the material hopper, remains on the material hopper. In this connection, the overload protection device according to the invention is designed in such way that neither the retention element nor the fastening device or any other components of material retention device are destroyed or damaged. The overload protection device to the invention can be, for example, a device with multiple elements, as will be described precisely below. Due to the destruction and/or damage-free detachment of the retention element, the invention enables the retention element, which was detached from the material hopper during normal operation of the road construction machine, to be easily refastened without having to replace the retention element with a new one. Thus, the invention prevents that the retention element on the fastening device is stripped from the transport vehicle in a way that the material of the retention element is damaged and thus destroyed. The retention element detached through the use of the overload protection device according to the invention prior to damage and/or destruction can therefore be reused and refastened to the material hopper, particularly by using the same fastening device as before, which is likewise reused. Naturally, normal signs of wear will continue to appear on the retention element according to the invention, so that it will have to be replaced at some point. Nevertheless, through the application of the invention, it is possible to replace a much smaller number of retention elements in normal operation of the road construction machine, so that time and costs can be saved.

The overload protection device according to the invention can be designed in many ways using the basic concept according to the invention. The overload protection device is ideally achieved through the material retention device and the fastening device, particularly through their interaction. In general, it is preferred that the fastening device fastens the retention element on the material hopper by means of a force fit and/or a, particularly elastic, form lock. In this regard, the maximum static friction of the force fit and/or the maximum retention force of the, particularly elastic, force fit, particularly together, correspond to the overload or the threshold value, at which overload protection becomes active, i.e., the material retention device detaches in an essentially controlled and destruction-free manner. The fastening device is, for example, designed in such a way that it presses the retention element against the material hopper or a side wall of the hopper, such that a static friction force develops, which must be overcome in order to pull the retention element out of the force fit of the fastening device. Thus, in a simple exemplary embodiment, the fastening device can be, for example, a clip, which presses the retention element against the material hopper, and which the retention element can be pulled out of if a respective overload or force is applied to the retention element, which reaches and/or exceeds the threshold value. The fastening device may also fasten the retention element on the material hopper, for example, through an elastic force fit. This is achieved, for example, by the fact that an elastic engagement, for example a hook, is designed on the material hopper and/or on the retention element, which engages a respective recess on the material hopper and/or on the retention element. If a force is now applied on the retention element, the fastening device is designed so that the retention element can be detached from the material hopper through an elastic deformation of the engagement. The force necessary for detaching the retention element can be set through the elasticity of the engagement or the elastic form fit and corresponds particularly to the overload or the previously described threshold value. An elastic engagement or elastic projection of this type can be particularly integrally designed with the retention element and thus be formed through the design of the retention element itself. This type of design of the overload protection device is particularly simple, and the reattachment of the destruction- or damage-free retention element detached from the material hopper can be made especially quickly and easily on the material hopper, as it must essentially only be inserted/clipped back into the elastic form lock or into the force fit of the fastening device.

Principally, the fastening device can be implemented in various ways. For example, fastening device may comprise a screw, which can be screwed into a threaded hole on the material hopper, and the retention element can be clamped under the head of the screw, or a respective washer, between the screw and the material hopper. To enlarge the area, over the screw can exert a force on the retention element, for example, the washer can be used, which is designed particularly integrally with the screw. It is, however, preferred over the screw that the fastening device comprises a threaded bolt and a nut, particularly a cap nut, preferably with an integrated stopper disc, mounted on the material hopper, particularly onto a side wall and protruding from the surface toward the hopper area. The threaded bolt a thread, onto which a respective nut can be screwed. The retention element is then clamped between the nut and the material hopper. The area, with which the nut exerts a force on the retention element, can be enlarged here as well through the use of a washer, which can be integrally designed, for example, with the nut. When using a cap nut, its thread is not from the material hopper in a mounted state. This is an advantage in that the paving material viscous and sticky material which could otherwise permeate into the thread and damage it. use of a threaded bolt and a nut as a fastening device has proved to be easy and quick to in practice.

Due to the fact that the fastening device for the retention element protrudes into the storage area of the material hopper, the fastening device should be designed as compact as possible or projecting away from the material hopper or from its side wall as minimally as possibly. In this manner, potential damage to the fastening device as well as to the rear of the transport vehicle can be avoided. Thus, it is particularly preferred that the threaded bolt is shorter than the thickness of the at least partly elastic retention element in a loosened state. thickness of the retention element describes in particular that extension of the retention element, which runs parallel to the longitudinal axis of the threaded bolt in an assembled state or the distance of both opposite maximum outer surfaces of the retention element. Because threaded bolt is preferably shorter than the thickness of the retention element, the threaded does not project beyond the loosened retention element. Therefore, to attach the nut, the retention element must be somewhat compressed in the area around the threaded bolt until the thread of the nut can be engaged with the thread of the threaded bolt. This does not pose a problem in practice because the material of the retention element is normally flexible, elastic, and at least to a limited degree capable of being compressed. In this manner, after the nut was mounted on the threaded bolt, the retention element is compressed in the area of the nut, such that the fastening device does not protrude or only slightly protrudes beyond the retention element. Thus, a particularly compact design of the fastening device can be implemented, which leads to less damage in this case. The retention element frequently consists, for of fabric-reinforced rubber material or similar. The retention elements used can differ in their size dimensions regardless of the size of the construction machine. A retention element is preferably at least one meter, particularly at least 2 meters, and not more than 3 meters, particularly not more than 2.5 meters long, preferably at least 15 cm, particularly at least 25 and not more than 40 cm, particularly not more than 35 cm high, and at least 0.5 cm, particularly at least 1 cm, and not more than 4 cm, particularly not more than 3 cm thick.

The force with which the retention element is pressed onto the material hopper, and therefore the resulting static friction force which must be overcome to detach the retention element, can be set by adjusting how far the fastening device is screwed on the material This setting can be made by the operator, for example, when attaching the respective device. However, to ensure that an operator does not have to estimate or determine, for example, by means of a torque wrench, how much he should tighten the fastening device to enable a destruction- or damage-free detachment of the retention element from the material hopper each time the retention element is mounted on the material hopper, it is preferred that the overload protection device according to the invention has a mounting aid. The mounting ensures that the overload or the threshold value is essentially set identically for each installation of the retention element and corresponds to a specified value. It can be designed, for example, such that a screw-in stop is present on the fastening device and/or the material hopper, which restricts the extent to which the retention element is pressed onto the material hopper in that the fastening device is stopped by the screw-in stop. In other words, the screw-stop is designed such that the fastening device can only be screwed so far that the static between the retention element and the material hopper corresponds with the overload or the threshold value in an assembled state. In this manner, a defined clamping condition is which produces always the same predetermined contact pressure, with which the retention element is pressed onto the material hopper. This ensures that the overload protection device reliably detaches the retention element from the material hopper before the retention element can be damaged and/or destroyed. The screw-in stop may consist in that, for example, a threaded hole for a screw of the fastening device in the material hopper or on its side wall has a specified depth, such that a screw that may be screwed into the threaded hole stops at base of the threaded hole if a predetermined screw-in depth is reached. The threaded hole is then designed as a blind hole. On the other hand, for example, a thread can be designed on screw and/or the threaded bolt that only extends to a specific point that the screw or the nut only be screwed onto the threaded bolt to a specified depth. Moreover, a screw-in stop can be provided on the nut, for example, through a specified depth of a threaded hole of a cap nut, which can only be screwed onto a threaded bolt until it hits the base of the threaded hole of cap nut.

It is generally sufficient if the force lock and/or the elastic form fit of the overload protection device according to the invention is arranged on a face side or on an end, and particularly on the edge, of the retention element. Based on the previously described designs, respective mounting of the retention element on the material hopper can be achieved in this case. However, to further improve the mounting of the retention element on the material hopper, it is beneficial to arrange the fastening device not on the edge of the retention but further towards its center. For this, it is necessary that the retention element have a fastening opening, through which the fastening device passes through the retention element. still enable the retention element to be detached from the material hopper without destroying damaging it, a release recess is then also designed in the retention element according to the invention, through which the fastening device can slide out of the retention element. Thus, it overall preferable if the retention element has a fastening opening, through which the device penetrates through the retention element, and a release recess, wherein the release is designed as a slit running particularly linearly from the fastening opening to the edge of the retention element. The fastening device is particularly capable of passing through the release recess if the overload protection device detaches the retention element from the material hopper. The retention element therefore has a fastening opening, namely a hole, through the fastening device is guided towards the material hopper. The fastening device, particularly in the form of a nut, then squeezes the material retention device against the hopper wall in the area around the hole in an assembled state. In addition to this fastening opening, the retention element has a release recess, which opens the fastening opening towards the edge of the retention element. The release recess runs therefore from the fastening opening, particularly transversely to the axis of passage of the fastening opening, to the edge of the retention element. In particular, the release recess therefore enables the retention element to be released through a movement transverse to the longitudinal extension or screw axis of the fastening device. Upon moving the retention element transversely to the longitudinal axis or screw axis of the fastening device, the fastening device is accordingly passed along the or through the release recess until the retention element is detached from the fastening device. However, it should be noted in this context that the fastening device remains fastened on the material hopper and the movement is performed by the retention element. Therefore, if a movement of fastening device is referred to in the present case, this means movement relative to the element. In the case of a linear design of the release recess, it is particularly easy to ensure the retention element is not destroyed or damaged during this detachment. The design of the release recess therefore corresponds to a slot or a cut in the retention element. Due to the arrangement of the fastening device in the center region instead of the edge of the retention element, a larger area is available around the fastening opening for the design of a force lock for the retention element between the fastening device and the material hopper. Particularly a washer under a screw or a nut can exert force on the retention element in the direction of the material hopper across a larger contact surface on the retention element. Damage to the retention element can also be particularly effectively prevented due to a more even of the force across this larger area.

The design of a fastening opening and a release recess enables a particularly simple arrangement of an elastic form fit between the fastening device and the retention element. For example, the retention element can be designed elastically and the release recess can be narrower than the diameter of the fastening device, such that an elastic form fit exists between the fastening device and the retention element. In other words, the release recess is designed thinner or narrower than the diameter of the fastening device passing through the fastening opening. For the fastening device to be able to be passed through the release recess, the release recess must be widened. The force necessary for this elastic deformation enhances the strength of the retention element on the material hopper.

Normally, the retention element of the transport vehicle is torn from the material hopper in the operating direction of the road construction machine. Thus, it is advantageous if the overload protection device is designed such that it actuates with a movement of the retention element in the operating direction of the road construction machine or becomes active in the case of forces impacting the retention element in this direction. To achieve this, it is preferred that the longitudinal extension of the release recess runs from the fastening opening opposite the operating direction of the road paver or feeder, and particularly horizontally. Therefore, in other words, the release recess runs essentially as the fastening device moves relatively to the retention element if it is pulled forward or torn by a transport vehicle, or in the direction of the tensile force acting on the material retention device.

Principally, it is possible to fasten the retention element on the material hopper using a single fastening device. However, damage to the retention element can therefore be reduced or prevented by distributing the forces necessary for mounting the retention element on the material hopper to different points of the retention element. For this purpose, it is preferably provisioned that multiple fastening devices are provided, particularly for each mounting side, through which the retention element is fastened on the material hopper. They can be arranged particularly vertically staggered on the retention element. This means that the fastening devices are arranged in a step-like manner, i.e., vertically and horizontally offset with respect to each other. This type of arrangement of the fastening devices results in a particularly advantageous force distribution on the retention element, which is particularly effective in preventing damage.

When using multiple fastening devices, it is generally sufficient to provision a single release recess, through which all fastening devices can pass. However, because this type of release recess must be designed to be relatively large, it can cause a negative impact on the stability of the retention element. Thus, it is preferred that respectively a separate release recess is provided for each fastening device. As a result, the individual release recesses can be designed thinner or smaller, through which the stability of the retention element is less afflicted. Moreover, for an easiest possible detachment of the retention element, it is preferred that the release recesses are designed to run parallel to each other. This means, in particular, that the longitudinal extension runs parallel to the elongated recesses.

The retention element can be designed, for example, as a wide rubber tab or as a lip, which is essentially designed rectangularly. The retention element is mounted on the material hopper, particularly on a side wall, on one of its ends or face sides. It has turned out advantageous in practice to deviate from the previously usual largely rectangular shape in a way that the retention element has a tapered design on a face side mounted on the material hopper, and particularly tapered off on a vertically lower side. When viewed in the operating direction of the road construction machine, the retention element therefore drops backwards this end in the operating direction and diagonally vertically downwards. In this manner, the retention element achieves a lower tip here in the assembled state. It has been demonstrated that, in this form, the retention element, firstly, can be particularly reliably mounted on the material hopper and, secondly, hinders neither the paving material nor the rear of a transport vehicle.

Furthermore, additional embodiments of the invention are conceivable. For example, a sensor can be arranged on the road construction machine, which detects whether the retention element is mounted on the material hopper or not. This can be, for example, an optical sensor or a tactile sensor, which generates a respective signal and indicates to the operator of the road construction machine if the retention element was detached from the material hopper. The sensor can be connected, for example, to the onboard computer of the road construction machine to display the absence of the retention element.

The object mentioned above is further achieved with a material retention device for a road construction machine, particularly a road paver or a feeder, as previously described. All benefits and impacts that were described above likewise apply for the material retention device according to the invention. In particular, the material retention device comprises at least one or more of the following features: the material retention device has an overload protection device; the material retention device comprises a retention element, wherein the retention element has a fastening opening, through which a fastening device penetrates the retention element, and a release recess, wherein the release recess is designed as a slot running particularly linearly from the fastening device to the edge of the retention element; the retention element is designed elastically, and the release recess is narrower than the diameter of the fastening device, such that an elastic form fit exists between the fastening device and the retention elements; the longitudinal extension of the release recess runs parallel to a contact side of the retention element and particularly horizontally; multiple fastening devices are provisioned, which are arranged vertically staggered on the retention element; and/or the retention element has a tapered design on a face side fastened on the material hopper, particularly in such a way that it tapers off on a vertically lower side. To avoid repetitions, reference is made to the previous discussion with respect to the road construction machine. Here, the overload protection device also enables the retention element of the material retention device to be detached from the fastening device of the material retention device. The contact side of the retention element is that side which is located vertically lower in an assembled state. The retention element rests against the material hopper of the road construction machine with the contact side. A material retention device according to the invention can also be designed particularly as a retrofit part for already existing road construction machines. In this way, the invention can be used with older road construction machines as well.

Moreover, the object mentioned above is further achieved with a method for protecting a material retention device of a road construction machine, specifically a road paver or a feeder, with the following steps: a) fastening a retention element of the material retention device to a material hopper of the road construction machine by means of a fastening device; and b) detaching the retention element from the material hopper in a destruction-free manner and without detaching the fastening device. "Without detaching the fastening device" means in the present case that the fastening device remains mounted on the material hopper. Thus, the fastening device remains in its position, in which it was placed upon installing the material retention device for fastening it. Only the retention element is therefore detached from the fastening device. In the process, the fastening device in itself remains on the material hopper, precisely as if it would still hold the retention element on the material hopper. Irreversible damage and/or destruction of the retention element while operating the road construction machine is reliably prevented with the method according to the invention. Naturally, all previously specified benefits and impacts for the design of the road construction machine likewise apply for the method according to the invention, and reference is made to the above discussion to avoid repetitions.

The advantages of using a release recess in the retention element were likewise already described above. In the method, it is also preferable to likewise provision sliding the retention element past the fastening device by means of a release recess arranged in the retention element in step b). The mounting of the retention element on the material hopper can be improved and overload protection can simultaneously be implemented through this embodiment of the invention with respect to the method as well.

BRIEF DESCRIPTION OF THE DRAWINGS

The invention will be explained in further detail below based on the exemplary embodiments shown in the figures. In the schematic figures.

DETAILED DESCRIPTION

Identical and identically functioning components are designated in the figures with the same reference signs. Recurring components are not separately designated in each figure.

Figure 1:
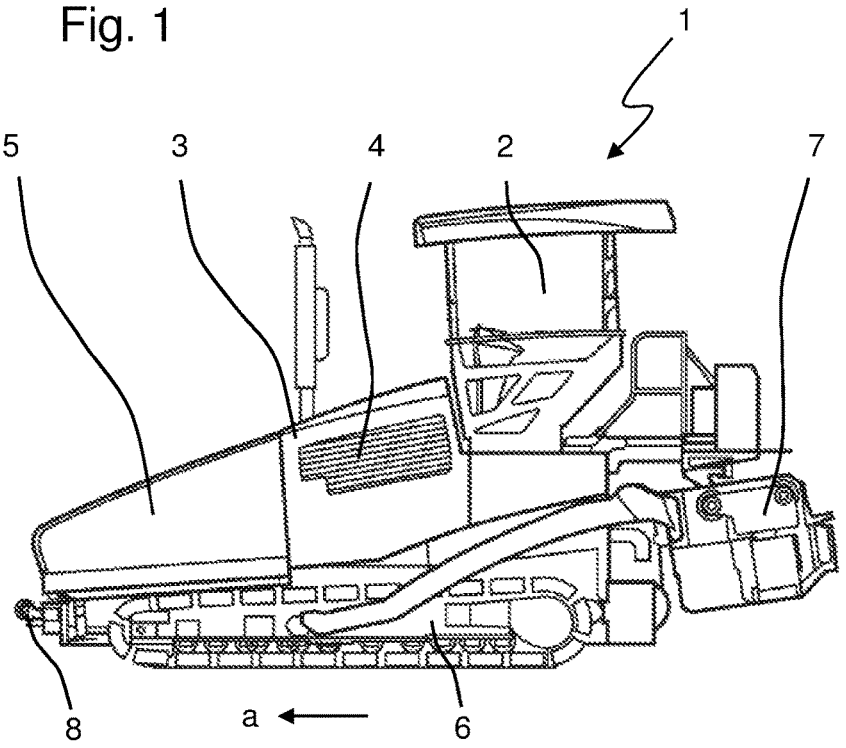
FIG. 1 is a side view of a road paver.
Figure 2:
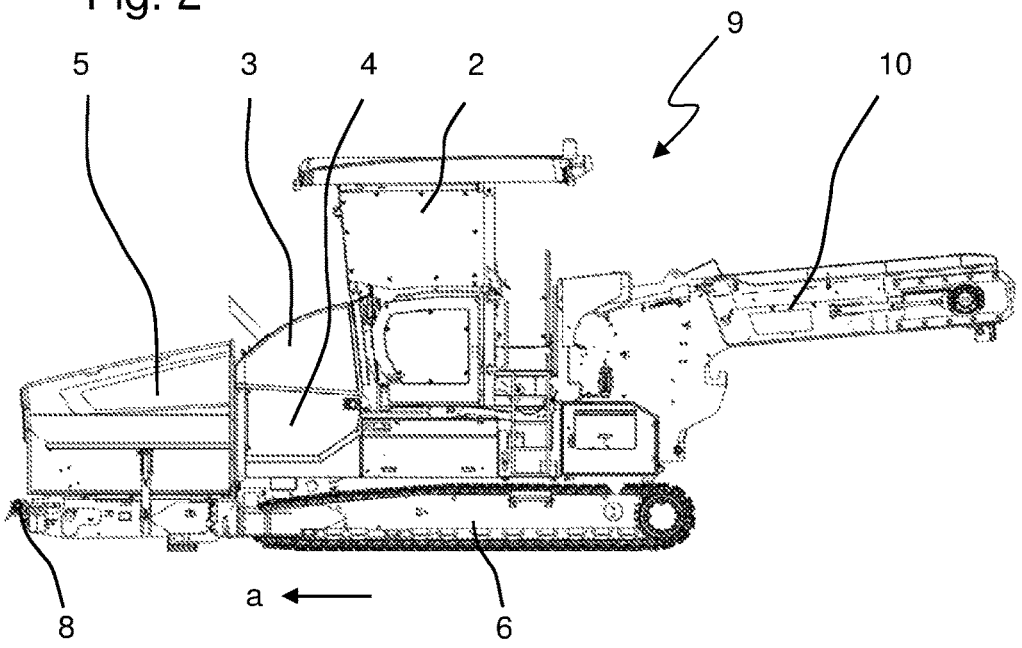
FIG. 2 is a side view of a feeder.

FIGS. 1 and 2 show generic road construction machines, namely a road paver 1 (FIG. 1) and a feeder 9 (FIG. 2). The road construction machines 1, 9 have an operator platform 2 and a machine frame 3. Furthermore, they comprise a travel carriage 6, with which road construction machines 1, 9 move forward in operating direction a and which is powered by a drive unit 4, which most frequently comprises a diesel engine. The road paver 1 has a paving screed 7 on its rear, with which it can spread, smooth, and compact paving material transversely to the operating direction a. The feeder 9 on the other hand does not comprise a paving screed 7, but rather a feed conveyor 10, with which it can transfer paving material to a road paver 1. The road paver 1 as well as the feeder 9 have a material hopper 5 for paving material. The feeder 9 can transfer paving material from its material hopper 5 via the fee conveyor 10 into the material hopper 5 of the road paver 1. Moreover, the road paver 1, as well as the feeder 9, may be supplied with paving material by a transport vehicle not depicted, for example, a truck. For this type of loading, the road construction machines 1, 9 have buffer rollers 8 arranged in the front in the operating direction a. Using the buffer rollers 8, they push a transport vehicle in front of them during the loading process, while paving material is transferred from the transport vehicle to the material hopper 5. During the paving of a base layer by a road paver 1, normally multiple loads of paving material must be transferred from transport vehicles to the road paver 1 and/or the feeder 9.

Figure 3:
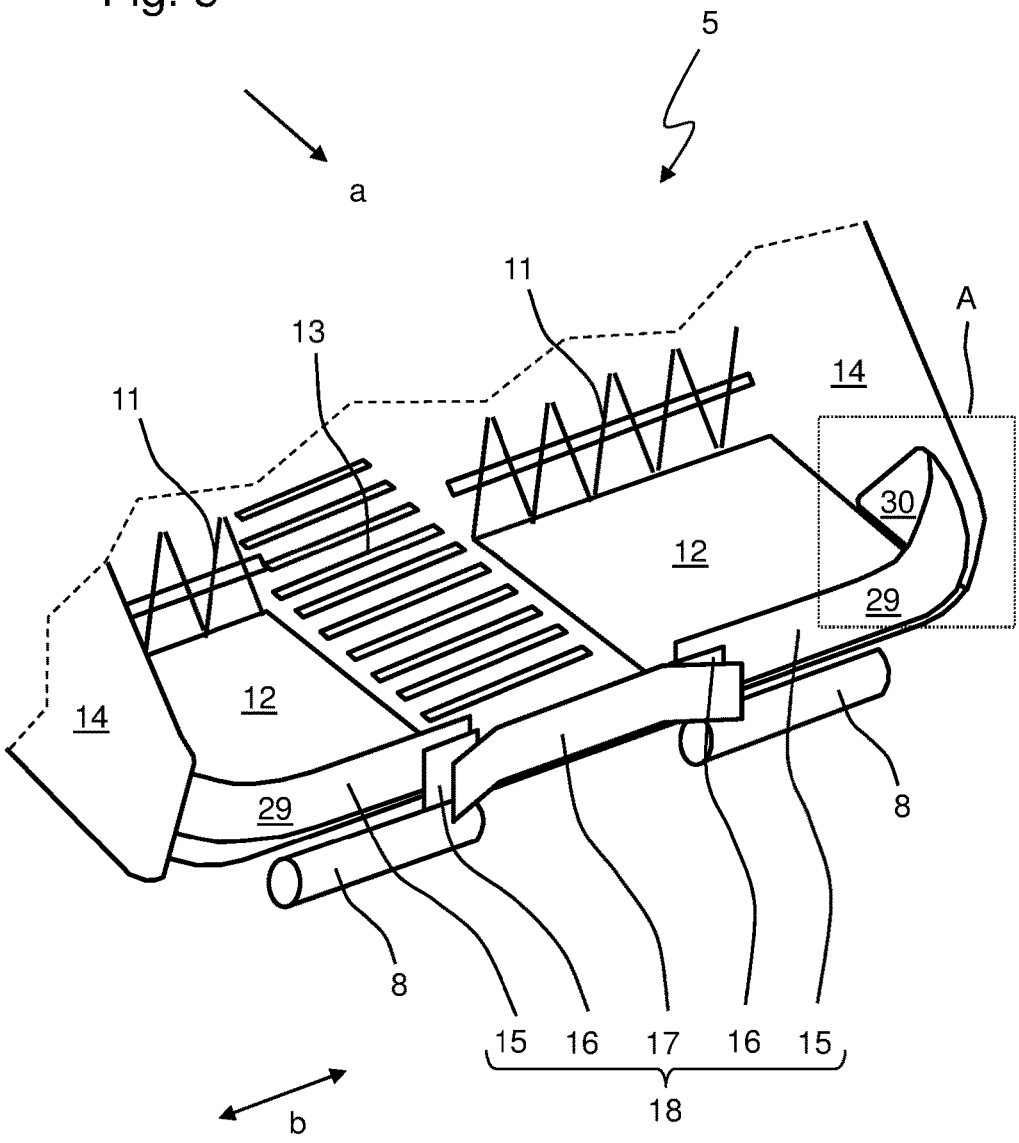
FIG. 3 is a perspective view of a material hopper.

FIG. 3 shows a perspective view diagonally from above and in the operating a in the front of the material hopper 5 of the road construction machines 1, 9. The material hopper 5 has a hopper floor 12 and side walls 14. The side walls 14 of the material hopper 5 be pivoted in normal operation to enable the hopper to be loaded and/or to influence the size the loading area. A screw conveyor 11 is located on the side of the material hopper 5 situated the rear in the operating direction a, which transfers the paving material from the material hopper 5 to a scraper belt 13, from which the paving material is conveyed in a direction opposite the operating direction a through the road construction machine 1, 9 and is either brought to a paving screed 7 or a feed conveyor 10.

On the side of the material hopper 5 situated in the front in the operating direction a, there is a material retention device 18. The material retention device 18 is located therefore on that side of the material hopper 5 on which a transport vehicle is pushed ahead during the loading process by the road construction machine 1, 9 via the buffer rollers 8. This side of the material hopper 5 is therefore also referred to as the filling side or the docking side. To enable the transfer process of the paving material from the transport vehicle to the material hopper 5, the material hopper 5 does not have a side wall projecting rigidly in the vertical direction on this side. Instead, the material retention device 18 is located here, which is composed of individual retention elements 15, 16, 17. The individual retention elements 15, 16, 17 are independently designed to enable the retention elements 15, 16, 17 to be displaced relative to each other. Thus, for example, the receiving volume of the material hopper 5 can be enlarged or reduced by pulling the hopper floor 12 apart or pushing it together in the direction of arrow b. Overall, the material retention device 18 has the effect that little or no paving material falls out of the material hopper 5 or is lost after or during loading from the transport vehicle to the material hopper 5 in the operating direction a. To ensure that the loading process is not impacted or hindered, the retention elements 15, 16, 17 of the material retention device 18 are designed elastically, for example, as rubber belts or rubber mats, particularly with fabric reinforcement. At least the retention elements 15 located on the outside transversely to the operating direction a, are mounted with their ends on the material hopper 5 or on side walls 4 of the material hopper 5. This connection of the retention elements 15 on the side walls 14 of the material hopper 5 is particularly exposed to high forces if the rear of the transport vehicle gets caught on the material retention device when loading the paving material, for example, when driving away after transferring the paving material. The retention element 15 is often torn out and damaged or destroyed at this point due to the enormous forces applied on the retention element 15. The retention elements 15 used in this case are about 2 meters long, about 3 centimeters high, and about 1 centimeter thick.

Figure 4:
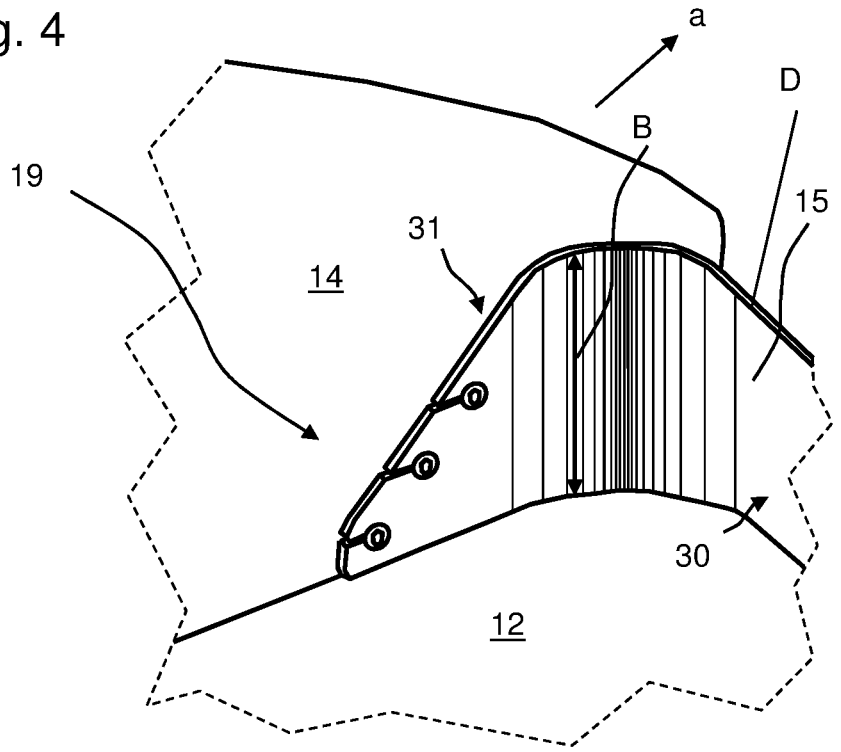
FIG. 4 is a perspective view of the connection of a retention element on the material hopper.
Figure 5:
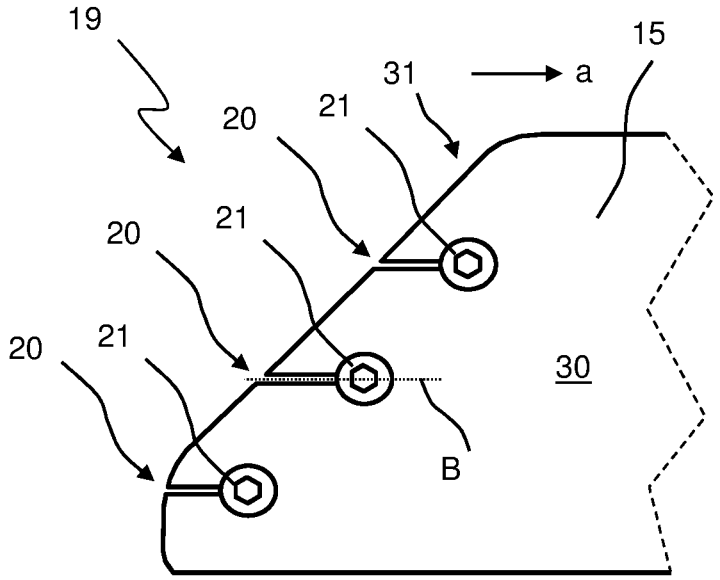
FIG. 5 is a side view of an end of a retention element fastened on the material hopper.

The overload protection 19 provisioned according to the invention is shown in further detail in FIGS. 4 and 5. FIG. 4 shows the end of the retention element 15, which is to the side wall 14 of the material hopper 5 according to Section A marked in FIG. 3. The retention element 15 is designed as a wide rubber belt, which is positioned essentially with its width B on the side of the material hopper 5 located in the front in the operating direction a. The thickness is designated with D and refers to the thickness of the retention element transversely to the width B or the distance of the two maximum outer surfaces of the retention element. The retention element prevents paving material from falling out of the material hopper 5 in this area. As revealed in FIGS. 4 and 5, the retention element 15 is fastened with its depicted end to the side wall 14 of the material hopper 5 via the fastening devices 21. As can also be seen in the figures, the retention element 15 is designed on this with a diagonal edge 31 in such a way that the edge 31 runs diagonally downwards vertically and the retention element 15 is therefore tapered or pointed. The tapered or pointed end of the retention element 15 is arranged on the side of the retention element 15 located vertically on bottom. Three fastening devices 21, through which the retention element 15 is fastened to the side wall 14 of the material hopper 5 are arranged vertically staggered with respect to each other in such a way that each fastening device 21 is spaced equally distant from the edge 31 the retention element 15 running diagonally. Thus, the fastening devices 21 are arranged in a step-like manner, which, especially together with the diagonal design of the end of the retention element 15, results in a particularly compact design and secure fastening of the material retention device 18 and particularly of the retention element 15. Release recesses 20 are also shown in FIGS. 4 and 5, through which the fastening devices 21 can be moved detachment of the retention element 15 from the fastening devices 21 and from the material hopper 5. During the detachment through the overload protection device 19, the retention element 15 moves forwards in the operating direction a in relation to the fastening devices 21 and the material hopper 5. As a result, the fastening devices 21 slide through the release recesses 20 and therefore release the retention element 15. The release recesses 20 extend in parallel to the operating direction a and parallel to each other. Thus, the overload protection device 19 is optimally geared for those forces that occur if the rear of a transport vehicle a tensile force on the retention element 15 when driving away from in front of road construction machine 1, 9, which would normally cause the retention element 15 to be destroyed.

Figure 6:
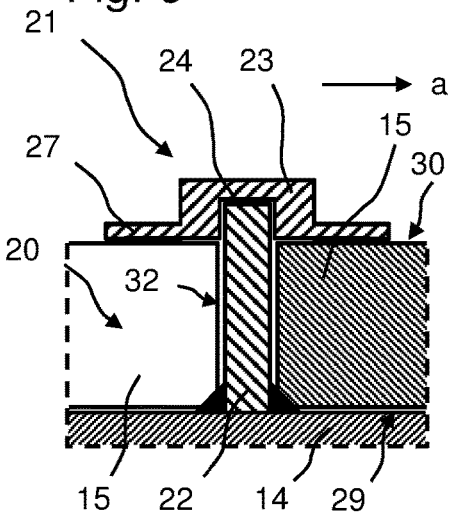
FIG. 6 is a sectional view of a first exemplary embodiment of a fastening device.

FIG. 6 shows a first embodiment of the fastening device 21 in a sectional view the section line B of FIG. 5. The retention element 15 is attached on the side wall 14 of the material hopper 5 via the fastening device 21. The fastening device 21 passes completely through the retention element 15 from its first side 29 up to its second side 30 through the fastening opening 32 provided in the retention element 15. The fastening device 21 comprises threaded bolt 22 welded onto the side wall 14 of the material hopper 5 with an external thread and a nut 23, in this case a cap nut, with a washer 27, which is designed here integrally with nut 23. The nut 23 comprises an internal thread, with which it can be screwed onto the bolt 22. The thread of the nut 23 is closed toward the loading area of the material hopper 5 so that no paving material can get into the thread of the nut 23 or onto the thread of the threaded bolt 22. At the same time, the blank end of the thread of the nut 23 acts as a screw-in stop 24, which precisely defines how far the nut 23 can be screwed onto the threaded bolt 22. Based this specification, the force applied by the nut 23 on the retention element 15 is always the same, whereby the retention element 15 is always pressed with equal force against the side 14 of the material hopper 5. Therefore, the same force is always needed for pulling out or detaching the retention element 15 from the fastening device 21 in the operating direction a. During this type of detachment process, the fastening device 21 or threaded bolt 22 moves in relation to the retention element 15 through the release recess 20 and thus slides along the retention element 15 without damaging it.

Figure 7:
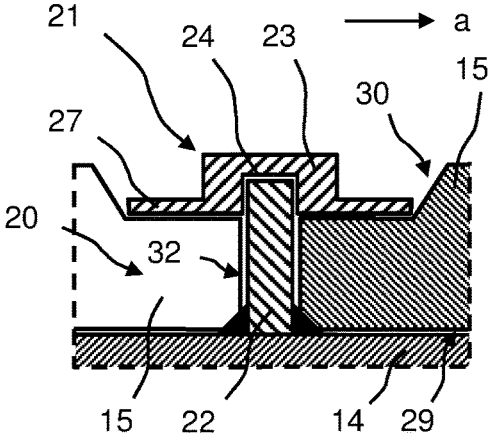
FIG. 7 is a sectional view of a second exemplary embodiment of a fastening device.

FIG. 7 shows a view corresponding to FIG. 6 with an additional embodiment of a fastening device 21. The fastening device 21 in FIG. 7 also has a material hopper 5 or threaded bolt 22 welded onto the side wall 14, onto which a nut 23 is screwed. Unlike the embodiment according to FIG. 6, the length of the threaded bolt 22 is shorter than the thickness of the retention element 15. The thickness of the retention element 15 particularly denotes the distance between the first side 29 and the second side 30 of the retention element 15. The two sides 29, 30 are respectively those sides of the retention element 15 which have the largest area. Due to the fact that the length of the threaded bolt 22 is shorter than the thickness of the retention element 15, the retention element 15 must be slightly compressed in the area of the fastening opening 32 until the nut 23 can be screwed onto the external thread of the threaded bolt 22. However, this is readily possible due to the material of the retention element 15. Because the fastening device 21 has an overall shorter design, it protrudes less beyond the second side 30 of the retention element 15. As a whole, the fastening device 21 is therefore less at risk of being damaged during operating by paving material in the material hopper 5 or by the rear of a transport vehicle transferring paving material.

Figure 8:
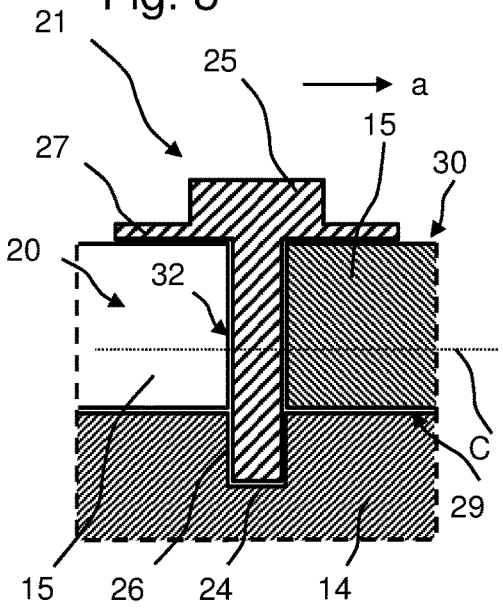
FIG. 8 is a sectional view of a third exemplary embodiment of a fastening device.

FIG. 8 shows an additional embodiment of the fastening device 21 pursuant to the view in accordance with FIG. 6. In contrast to the embodiments described above, the fastening device 21 of FIG. 8 has no threaded bolt 22 and no nut 23, but rather a screw 25, which is designed with an integrated washer 27 and which can be screwed into a threaded hole 26 in the side wall 14 of the material hopper 5. The threaded hole 26 of the material hopper 5 is designed as a blind hole and thus has a screw-in stop 24. The screw-in stop 24 restricts how far the screw 25 can be screwed into the threaded hole 26 and therefore the force with which the screw 25 holds the retention element 15 on the material hopper 5. In the event the retention element 15 is detached from the fastening device 21 by the overload protection device 19, the screw 25 will move with its shaft relative to the retention element 15 through the release recess 20 without the retention element 15 being damaged or destroyed in the process.

Figure 9:
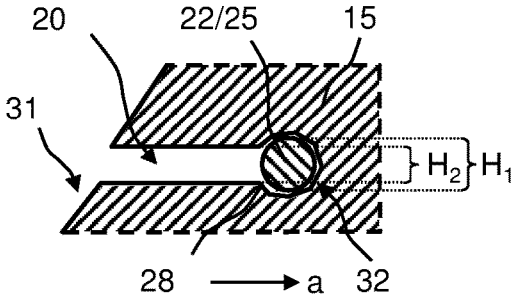
FIG. 9 shows a first exemplary embodiment of a release recess.
Figure 10:
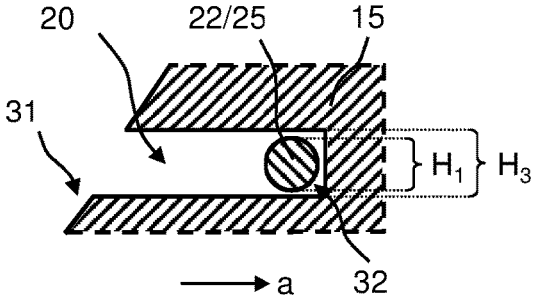
FIG. 10 shows a second exemplary embodiment of a release recess.

FIGS. 9 and 10 show different embodiments of the release recess 20 in a sectional view along the line C according to FIG. 8. In each case, the retention element 15 has a fastening opening 32. The fastening device 21, or more specifically the threaded bolt 22 or shaft of screw 25, extends through the fastening opening 32. The shaft of the screw 25 or the threaded bolt 22 has a diameter $H_1$. In contrast, the embodiment of the release recess 20 depicted in FIG. 9 has a passage width or clear width $H_2$ which is narrower than diameter The release recess 20 connects the fastening opening 32 with the edge 31 of the retention element 15. In other words, the fastening opening 32 is opened towards the edge 31 through release recess 20. Thus, there is a continuous recess from the edge 32 to the fastening device in the fastening opening 32. Due to the different dimensions of diameter $H_1$ of the fastening device 21 and the passage width $H_2$ of the release recess 20, an elastic stop 28 develops on transition between the fastening opening 32 and the release recess 20, which forms an elastic form lock between the retention element 15 and the fastening device 21. The elastic form is based on the elasticity of the material of the retention element 15, and its strength can be adjusted through the elasticity of this material. Now, if the retention element 15 is to be detached from the fastening device 21 and thus from the material hopper 5, in addition to the force fit, which is effected by the fastening device 21 pressing the retention element 15 onto material hopper 5, the elastic form lock must likewise be overcome on the elastic stop 28. In other words, to ensure that the threaded bolt 22 or the shaft of the screw 25 can slide through the release recess 20, it must first be widened to the diameter $H_1$ of the fastening device 21. Together with the force fit through the fastening device 21, the force necessary for this adds to the total retention force that fastens the retention element 15 on the material hopper 5 and the fastening device 21. In contrast, the retention element 20 has a passage width $H_3$ which is larger than diameter $H_1$ of the threaded bolt 22 or the shaft of the screw 25 in the alternative embodiment according to FIG. 10. Thus, once the force fit has been overcome by the fastening device 21, it can pass through the release recess 20 unhindered. Due to the retention element 21 sliding along unhindered through the release recess 20 in this embodiment, to the retention element 15 is prevented particularly efficiently.

Figure 11:
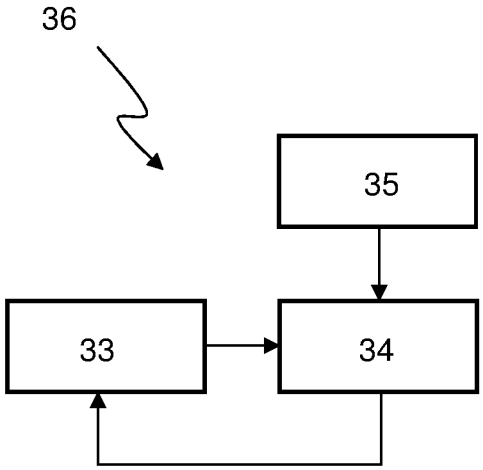
FIG. 11 is a flowchart of the method.

FIG. 11 shows a flowchart of the method 36 according to the invention. The method begins in step 33 with the fastening of the retention element 15 on the material hopper 5 by means of the fastening device 21. Subsequently, if an overload occurs during normal of the road construction machine 1, 9, i.e., if forces are applied to the retention element 15 which exceed the specified threshold value, the retention element 15 will be detached from material hopper 5 in step 34 without damage or destruction, while the fastening device 21 is detached and continues to remain on the material hopper 5. In this connection, the threshold value is selected such that, on the one hand, the retention element 15 will not be detached if only those forces act upon it that can be absorbed by the elasticity of the material of the retention element 15 without damaging or destroying it. On the other hand, the threshold is selected such that the retention element 15 is ensured to be detached before a risk of or destruction of the retention element 15 occurs. The exact selection of the threshold value may vary depending on the used material for the retention element 15, and may be by means of simple trial and error. The threshold value on the overload protection device 19 set through the configuration of the fastening device 21 and/or a potential elastic form lock. in all, an overload protection device 19 is achieved which enables damage and/or destruction the retention element 15 to be reliably prevented. As illustrated by the reverse arrow in FIG. 11, the retention element 15 can be easily remounted in its position on the material hopper 5 after being successfully detached from the material hopper 5 or the fastening device 21 by detaching the fastening device 21 and then reattaching it with the retention element 15 on the material hopper 5. Thus, the retention element 15 can be protected against destruction and reused due to the method according to the invention, and does therefore not need to be by a new retention element 15. If the overload protection device 19 or the retention element is used with a release recess 20, step 34 (detachment of the retention element 15) may optionally be supplemented by step 35, which involves the retention element 15 passing past the fastening device 21 through the release recess 20 arranged in the retention element 15. Overall, the intensity of maintenance and the consumption of wear materials on the road construction machine 1, 9 according to the invention can be reduced in this manner, whereby the invention contributes to lowering operating costs.

What is claimed is:

1. A road paver or feeder comprising:

a machine frame;

a travel carriage powered by a drive unit;

a material hopper with a material retention device arranged in a front in an operating direction, the material retention device comprising at least one fastening device and a retention element fastened to the material hopper by the fastening device, wherein the material retention device has an overload protection device configured such that, in response to an applied overload, the retention element detaches from the material hopper and the fastening device, with the fastening device remaining on the hopper, without damage, and wherein a screw-in stop is provided on the fastening device and/or on the material hopper, which restricts an extent to which the fastening device presses the retention element onto the material hopper in that the fastening device is stopped by the screw-in stop.

2. The road paver or feeder according to claim 1, wherein the fastening device fastens the retention element to the material hopper by a force fit and/or an elastic form lock.

3. The road paver or feeder according to claim 1, wherein the fastening device comprises a threaded bolt.

4. The road paver or feeder according to claim 3, wherein the threaded bolt is mounted on the material hopper and/or is shorter than a thickness of the retention element.

5. The road paver or feeder according to claim 3, wherein a nut connects with the threaded bolt and provides the screw-in stop.

6. The road paver or feeder according to claim 1, wherein the retention element has a fastening opening, through which the fastening device penetrates the retention element, and a release recess, the release recess being a slot running from the fastening opening to an edge of the retention element.

7. The road paver or feeder according to claim 6, wherein the retention element is configured to be elastic and the release recess is narrower than a diameter of the fastening device such that an elastic form lock exists between the fastening device and the retention element.

8. The road paver or feeder according to claim 6, wherein a longitudinal extension of the release recess runs from the fastening opening in a direction horizontally opposite the operating direction of the road paver or feeder.

9. The road paver or feeder according to claim 1, wherein the at least one fastening device comprises a plurality of fastening devices, which are arranged on the retention element vertically staggered to each other.

10. The road paver or feeder according to claim 9, wherein one release recess is provided for each fastening device of the plurality of fastening devices, respectively, and the release recesses are configured to run parallel to each other.

11. The road paver or feeder according to claim 1, wherein the retention element has a tapered design on a face side mounted on the material hopper, and is tapered off on a vertically lower side.

12. A road paver or feeder comprising:

a machine frame;

a travel carriage powered by a drive unit;

a material hopper with a material retention device arranged in a front in an operating direction, the material retention device comprising at least one fastening device and a retention element fastened to the material hopper by the fastening device, wherein the material retention device has an overload protection device configured such that, in response to an applied overload, the retention element detaches from the material hopper and the fastening device, with the fastening device remaining on the hopper, without damage, and wherein the retention element has a fastening opening, through which the fastening device penetrates the retention element, and a release recess, the release recess being a slot running from the fastening opening to an edge of the retention element.

13. The road paver or feeder according to claim 12, wherein the fastening device fastens the retention element to the material hopper by a force fit and/or an elastic form lock.

14. The road paver or feeder according to claim 12, wherein the fastening device comprises a threaded bolt.

15. The road paver or feeder according to claim 14, wherein the threaded bolt is mounted on the material hopper and/or is shorter than a thickness of the retention element.

16. The road paver or feeder according to claim 14, wherein a nut connects with the threaded bolt.

17. The road paver or feeder according to claim 12, wherein a screw-in stop is provided on the fastening device and/or on the material hopper, which restricts an extent to which the fastening device presses the retention element onto the material hopper in that the fastening device is stopped by the screw-in stop.

18. The road paver or feeder according to claim 12, wherein the retention element is configured to be elastic and the release recess is narrower than a diameter of the fastening device such that an elastic form lock exists between the fastening device and the retention element.

19. The road paver or feeder according to claim 12, wherein a longitudinal extension of the release recess runs from the fastening opening in a direction horizontally opposite the operating direction of the road paver or feeder.

20. The road paver or feeder according to claim 12, wherein the at least one fastening device comprises a plurality of fastening devices, which are arranged on the retention element vertically staggered to each other.

21. The road paver or feeder according to claim 20, wherein one release recess is provided for each fastening device of the plurality of fastening devices, respectively, and the release recesses are configured to run parallel to each other.

22. The road paver or feeder according to claim 12, wherein the retention element has a tapered design on a face side mounted on the material hopper, and is tapered off on a vertically lower side.

23. A road paver or feeder comprising:

a machine frame;

a travel carriage powered by a drive unit;

a material hopper with a material retention device arranged in a front in an operating direction, the material retention device comprising at least one fastening device and a retention element fastened to the material hopper by the fastening device, wherein the material retention device has an overload protection device configured such that, in response to an applied overload, the retention element detaches from the material hopper and the fastening device, with the fastening device remaining on the hopper, without damage, and wherein the at least one fastening device comprises a plurality of fastening devices, which are arranged on the retention element vertically staggered to each other.

24. The road paver or feeder according to claim 23, wherein the fastening device fastens the retention element to the material hopper by a force fit and/or an elastic form lock.

25. The road paver or feeder according to claim 23, wherein the fastening device comprises a threaded bolt.

26. The road paver or feeder according to claim 25, wherein the threaded bolt is mounted on the material hopper and/or is shorter than a thickness of the retention element.

27. The road paver or feeder according to claim 25, wherein a nut connects with the threaded bolt.

28. The road paver or feeder according to claim 23, wherein a screw-in stop is provided on the fastening device and/or on the material hopper, which restricts an extent to which the fastening device presses the retention element onto the material hopper in that the fastening device is stopped by the screw-in stop.

29. The road paver or feeder according to claim 23, wherein the retention element has a fastening opening, through which the fastening device penetrates the retention element, and a release recess, the release recess being a slot running from the fastening opening to an edge of the retention element.

30. The road paver or feeder according to claim 29, wherein the retention element is configured to be elastic and the release recess is narrower than a diameter of the fastening device such that an elastic form lock exists between the fastening device and the retention element.

31. The road paver or feeder according to claim 29, wherein a longitudinal extension of the release recess runs from the fastening opening in a direction horizontally opposite the operating direction of the road paver or feeder.

32. The road paver or feeder according to claim 23, wherein one release recess is provided for each fastening device of the plurality of fastening devices, respectively, and the release recesses are configured to run parallel to each other.

33. The road paver or feeder according to claim 23, wherein the retention element has a tapered design on a face side mounted on the material hopper, and is tapered off on a vertically lower side.

* * * * *